United States Patent [19]

Johnson et al.

[11] Patent Number: 4,765,883

[45] Date of Patent: Aug. 23, 1988

[54] PROCESS FOR THE PRODUCTION OF AROMATICS BENZENE, TOLUENE, XYLENE (BTX) FROM HEAVY HYDROCARBONS

[75] Inventors: Axel R. Johnson, North Babylon, N.Y.; S. Narayanan, Westwood, Mass.; Herman H. Woebcke, Stamford, Conn.

[73] Assignee: Stone & Webster Engineering Corporation, Boston, Mass.

[21] Appl. No.: 435,608

[22] Filed: Oct. 20, 1982

[51] Int. Cl.[4] ..... C10G 9/16

[52] U.S. Cl. ..... 208/78; 208/72; 208/130; 585/303; 585/407; 585/415; 585/648; 585/650

[58] Field of Search ..... 208/78, 130, 72; 585/648, 650, 303, 407, 415

[56] References Cited

U.S. PATENT DOCUMENTS

| | | | |
|---|---|---|---|
| 2,149,860 | 3/1939 | Morrell | 208/72 |
| 2,653,903 | 9/1953 | Kilpatrick | 208/72 |
| 2,890,256 | 6/1959 | King | 585/652 |
| 2,928,886 | 3/1960 | Nisbet et al. | 585/650 |
| 2,943,994 | 7/1960 | McCain, Jr. | 208/48 Q |
| 3,487,121 | 12/1969 | Hallee | 585/258 |
| 3,565,970 | 2/1971 | Kelley | 585/303 |
| 3,579,438 | 5/1971 | Cruse | 208/130 |
| 3,579,601 | 5/1971 | Kivlen | 585/652 |
| 3,641,183 | 2/1972 | Cahn et al. | 208/72 |
| 3,676,519 | 7/1972 | Dorn et al. | 208/48 Q |
| 3,711,568 | 1/1973 | Cooper | 585/648 |
| 3,842,122 | 10/1974 | Wolk et al. | 208/48 Q |
| 3,878,088 | 4/1975 | Nahas et al. | 208/50 |
| 3,907,661 | 9/1975 | Gwyn et al. | 208/48 Q |
| 4,021,501 | 5/1977 | Dyer et al. | 585/651 |
| 4,022,556 | 6/1977 | Satchell, Jr. | 208/108 |
| 4,268,375 | 5/1981 | Johnson et al. | 208/72 |

FOREIGN PATENT DOCUMENTS

| | | |
|---|---|---|
| 1348293 | 2/1963 | France . |
| 41-19886 | 11/1966 | Japan . |
| 5265203 | 11/1975 | Japan . |
| 7605485 | 5/1976 | Netherlands . |
| 789049 | 1/1958 | United Kingdom . |
| 1253771 | 11/1971 | United Kingdom . |
| 1292789 | 10/1972 | United Kingdom . |
| 1309309 | 3/1973 | United Kingdom . |

*Primary Examiner*—William R. Dixon, Jr.
*Assistant Examiner*—Ellen McAvoy
*Attorney, Agent, or Firm*—Hedman, Gibson, Costigan & Hoare

[57] ABSTRACT

A process for producing improved yields of aromatics (benzene, toluene, xylene) by initially partially thermally cracking heavy hydrocarbon and thermally cracking ethane to high conversion and then completely cracking the partially cracked heavy hydrocarbon with the completely cracked ethane.

6 Claims, 1 Drawing Sheet

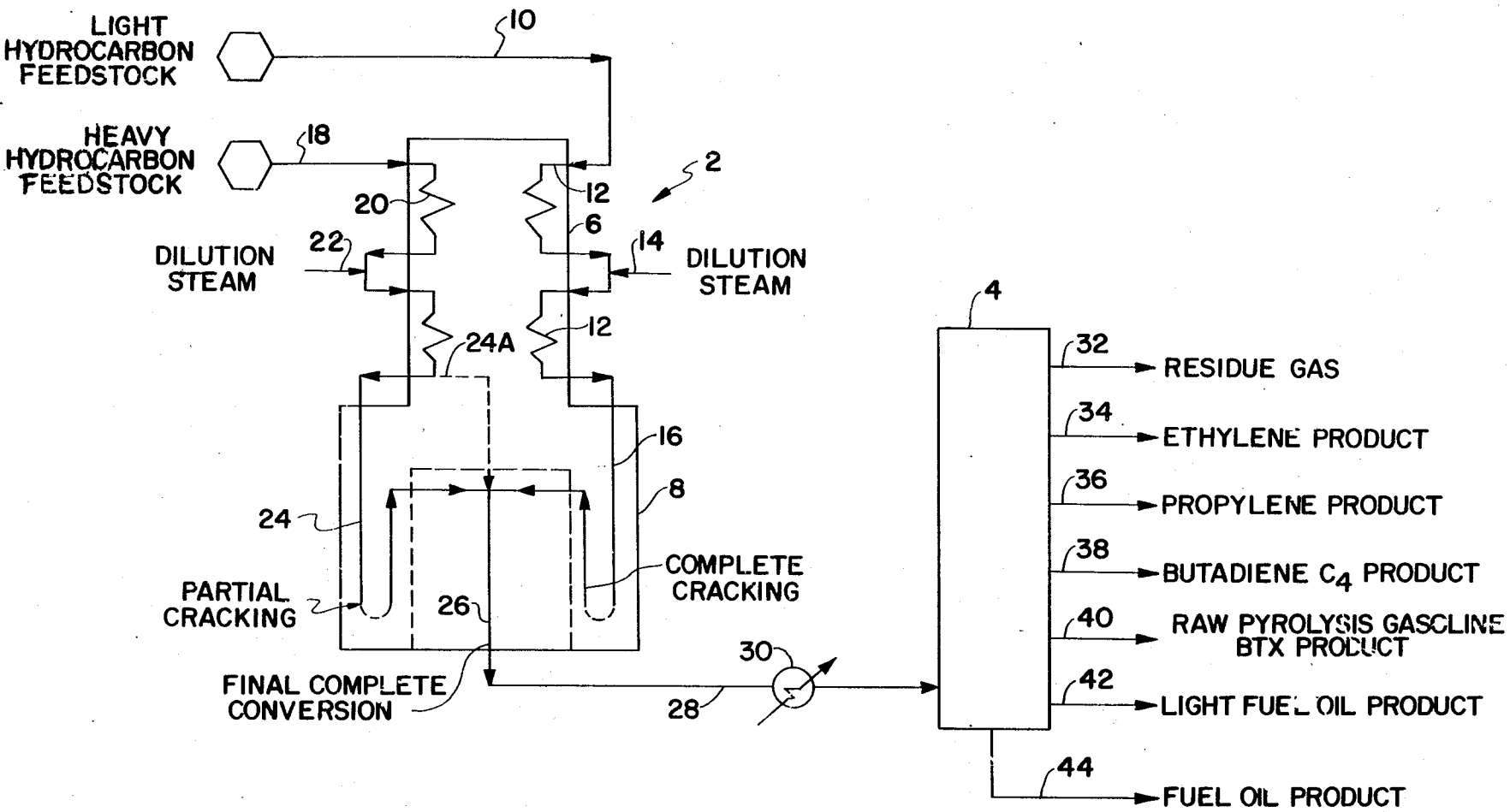
LIGHT HYDROCARBON FEEDSTOCK
HEAVY HYDROCARBON FEEDSTOCK
DILUTION STEAM
DILUTION STEAM
PARTIAL CRACKING
FINAL COMPLETE CONVERSION
COMPLETE CRACKING
RESIDUE GAS
ETHYLENE PRODUCT
PROPYLENE PRODUCT
BUTADIENE $C_4$ PRODUCT
RAW PYROLYSIS GASOLINE BTX PRODUCT
LIGHT FUEL OIL PRODUCT
FUEL OIL PRODUCT
2
4
6
8
10
12
12
14
16
18
20
22
24
24A
26
28
30
32
34
36
38
40
42
44

PROCESS FOR THE PRODUCTION OF AROMATICS BENZENE, TOLUENE, XYLENE (BTX) FROM HEAVY HYDROCARBONS

BACKGROUND OF THE INVENTION

Cross Reference to Related Applications

This invention is related to Ser. No. 431,588 now U.S. Pat. No. 4,492,624, entitled PROCESS AND APPARATUS FOR THE PRODUCTION OF OLEFINS FROM BOTH HEAVY AND LIGHT HYDROCARBONS (by Herman N. Woebcke, et al) filed Sept. 30, 1982 as a result of a common development effort.

FIELD OF THE INVENTION

This invention relates generally to cracking heavy hydrocarbons such as kerosene and heavier hydrocarbons. The invention is specific to the improvement in yields of aromatics (BTX) under conditions wherein ethane is used as the principal diluent in cracking the heavy hydrocarbon.

DESCRIPTION OF THE PRIOR ART

Thermal cracking of hydrocarbons to produce olefins has now become well established and well known. Typically, thermal cracking proceeds by delivering a hydrocarbon feed to a pyrolysis furnace wherein the hydrocarbon feed is first elevated in temperature to an intermediate level in a convection zone, and thereafter cracked to completion in a radiant zone in the furnace. The cracked product is then quenched to terminate the reactions occurring in the pyrolysis gas and fix the product spectrum to obtain the most desirable yield of olefins and aromatics.

It is well known in the process of cracking hydrocarbons, that the reaction temperature and reaction residence time are two of the primary variables in determining the product distribution. The product distribution spectrum obtained during thermal cracking is a function of the severity level of the cracking process, the residence time and the hydrocarbon pressure profile maintained in the coil of the reactor zone of the furnace. Severity is a term used to describe the intensity of the cracking conditions.

It is generally known that higher quantities of olefins are obtained when short residence times and low hydrcarbon pressures are maintained in the reaction zone of the thermal cracking furnace. Short residence times are typically 0.1 to about 0.3 seconds and low hydrocarbon pressures are 5 to about 18 psia. However, the quantities of benzene, toluene and xylene (BTX) produced during thermal cracking are believed to be unaffected by residence time and hydrocarbon partial pressure. It is the current belief that the content of the BTX in the pyrolysis effluent is principally a function of the quality of the feedstock. Accordingly, for a given feedstock the production of BTX in the raw pyrolysis gasoline (RPG) at a given conversion level is essentially constant.

SUMMARY OF THE INVENTION

It is a principal object of this invention to provide a method—a method which was coincidentally arrived at during the investigations of DUOCRACKING—by which the BTX content in the raw pyrolysis gasoline (RPG) portion of a thermally cracked effluent can be increased, compared to that possible at a given conversion level—using prior art.

It is a further object of the present invention to provide a process in which the BTX content in the raw pyrolysis gasoline portion of the cracked effluent can be increased and at the same time the undesirable $C_5$ and higher diolefins be decreased.

It is a further object of the present invention to provide a process in which a particular light hydrocarbon, uniquely suited for increasing the BTX content in the pyrolysis gas content, is selected as a diluent for a heavy hydrocarbon.

It is another and further object of the present invention to provide a process in which heavy hydrocarbons such as kerosene, atmospheric gas oil and vacuum gas oil are cracked under conditions that provide an increased yield of BTX in the raw pyrolysis gas product.

In accordance with the process of the present invention, a heavy hydrocarbon, such as kerosene or heavier hydrocarbon, is partially cracked in a conventional pyrolysis furnace. At the same time ethane is cracked at a high conversion in the same pyrolysis furnace. Upon partial cracking of the heavy hydrocarbon, the cracked effluent from the cracked ethane effluent is delivered to the heavy hydrocarbon stream. This ethane serves as a diluent to effect complete cracking of the heavy hydrocarbon.

The heavy hydrocarbon is further cracked by the heat available from the ethane or additional radiant firing or the combination of the two.

DESCRIPTION OF THE DRAWING

The invention will be understood when considered with the following drawing which is a schematic diagram of a conventional pyrolysis furnace adapted to provide the process of the present invention.

DESCRIPTION OF THE PREFERRED EMBODIMENT

The process of the invention is directed to providing conditions under which heavy hydrocarbon can be cracked to provide an increased benzene, toluene and xylene (BTX) yield.

In general, the process relies on partially cracking hydrocarbons and thereafter completing the cracking with the cracked effluent from an ethane stream.

The heavy hydrocarbons contemplated for use in the cracking process are kerosene, atmospheric gas oils, vacuum gas oils and resid. The light hydrocarbon that is cracked to provide a diluent and heat source for cracking the heavy hydrocarbon is ethane. The process is a specific embodiment of the DUOCRACKING process.

As seen in the drawing, a conventional furnace 2 comprised of a convection zone 6 and a radiant zone 8 is provided with convection and radiant section lines capable of performing the process of the present invention.

The convection zone 6 of the present invention is arranged to receive a feedstock inlet line 10 for the ethane feedstock and an inlet line 18 for a heavy hydrocarbon feedstock. Coils 12 and 20 through which the ethane feedstock and heavy hydrocarbon feedstock pass respectively, are located in convection zone 6 of furnace 2. Lines 14 and 22 are provided to deliver dilution steam to convection coils 12 and 20, respectively.

Radiant zone 8 is provided with coils 16 for cracking the ethane feedstock to high conversion, coils 24 for partially cracking the heavy hydrocarbon feedstock and a common coil 26 in which the heavy hydrocarbon feedstock is cracked to completion and the effluent from the cracked ethane is, in effect, quenched to terminate the reactions. An effluent discharge line 28 is provided and conventional quench equipment such as an USX (Double Tube Exchanger) and/or a TLX (Multi-Tube Transfer Line Exchanger) are afforded to quench the cracked effluent.

The system also includes a separation system 4 which is conventional. As seen in the drawing, separation system 4 is adapted to separate the quench effluent into residue gas (line 32), ethylene product (line 34), propylene product (line 36) butadiene/$C_4$ product (line 38), raw pyrolysis gasoline/BTX product (line 40), light fuel oil product (line 42), and fuel oil product (line 44).

Optionally, a line 24A is provided to deliver the paritally cracked heavy hydrocarbon directly from the convection coil 20 to the common coil 26. Under certain conditions, the heavy hydrocarbon can be partially cracked in the convection zone 6 thereby rendering further cracking in the radiant zone unnecessary.

In essence, the process of the present invention is conducted by delivering the ethane feedstock through line 10 to the convection coils 12 in convection section 6 of furnace 2. Heavy hydrocarbon feedstock such as kerosene, atmospheric gas oil or vacuum gas oils are delivered through line 18 to the convection coils 20.

Dilution steam is delivered by line 14 to convection coils 12 through which the ethane feedstock is being passed. It is preferable that the dilution steam be superheated steam at temperatures from 365° to 1000° F. The dilution steam is mixed with the ethane feedstock at approximately 0.4 pound of steam per pound of feedstock. The composite ethane and dilution steam is elevated in temperature to approximately 1000° F. to 1200° F. in convection section 6. Thereafter, the heated dilute ethane is passed through coiil 16 in radiant section 8 of furnace 2. In the radiant section, the ethane feedstock is cracked under high conversion conditions to temperatures between 1500° F. and 1700° F. at a residence time of about 0.2 seconds.

At the same time, the heavy hydrocarbon feedstock is delivered through line 18 to convection coils 20 in convection zone 6 of furnace 2. Dilution steam is delivered by line 22 to convection coils 20 to mix with the heavy hydrocarbon in a ratio of about 0.15 to 0.30 pound of steam per pound of heavy hydrocarbon. The heavy hydrocarbon is elevated to a temperature between 900° F. and 1000° F. in convection zone 6 of furnace 2. Thereafter, the heavy hydrocarbon feedstock from convection section 6 is delivered to radiant coil 24, wherein it is partially cracked under medium severity conditions to temperatures of about 1200° F. to 1450° F. at residence times of about 0.05 seconds.

The partially cracked heavy hydrocarbon feedstock is delivered to common coil 26, and the fully cracked ethane pyrolysis gas from coil 16 is also delivered to common coil 26. In common coil 26, the fully cracked light hydrocarbon feedstock effluent provides heat to effect further cracking of the partially cracked heavy hydrocarbon and, concomitantly, the ethane effluent is quenched by the lower temperature of partially cracked heavy hydrocarbon. The composite product is cracked to the desired level, then quenched in conventional quench equipment and thereafter separated into the various specific products.

Illustrations of the process of the present invention show the enhanced yield of BTX over conventional processes.

The reported data in Example 1 is from the process example reported in the companion application entitled, PROCESS AND APPARATUS FOR THE PRODUCTION OF OLEFINS FROM BOTH HEAVY AND LIGHT HYDROCARBONS (Herman N. Woebcke, et al) and which is incorporated herein by reference.

EXAMPLE 1

| | Conventional | DUO-CRACKING |
|---|---|---|
| Feedstock | Gas Oil | Gas Oil (line 18) Ethane (line 10) |
| Cracking Intensity | | |
| $CH_4$ wt % | 8.5 | 8.5 |
| BTX Component (line 28) | 9.7 | 10.9 |
| Raw Pyrolysis Gasoline Products | | (line 40) |
| °API | 38.5 | 35.7 |
| Sp. Gr. 60/60 F | 0.832 | 0.847 |
| Bromine g/100 g | 77.1 | 71.6 |
| Iodine g/100 g | 25.7 | 26.1 |
| Boiling Range °F. | | |
| IBP | 109 | 124 |
| 50% | 206 | 213 |
| 95% | 370 | 369 |
| Analysis, C wt % | 90.09 | 90.28 |
| H | 9.91 | 9.72 |
| C/H | 9.09 | 9.29 |
| Hydrocarbon Types | | |
| Aromatics Vol % | 56 | 62 |
| Olefins | 43 | 37 |
| Saturates | 1 | 1 |
| RPG YIELDS | | |
| $C_5$-Mono Olefins | 5.63 | 3.06 |
| Isoprene | 3.81 | 2.04 |
| Other $C_5$ Di Olefins & Cyclopentene | 4.54 | 3.35 |
| Cyclopentadiene | 5.66 | 3.66 |
| Dicyclopentadiene | 1.12 | 0.72 |
| $C_5$'s | 20.76 | 12.83 |
| Methyl Cyclopentadiene | 0.80 | 0.96 |
| Benzene | 18.8 | 21.9 |
| Toluene | 14.5 | 16.7 |
| Ethylbenzenes | 2.11 | 2.18 |
| P-Xylene | 1.31 | 1.37 |
| M-Xylene | 2.87 | 2.99 |
| O-Xylene | 2.88 | 2.84 |
| Styrene | 1.75 | 1.98 |
| BTX | 45.02 | 50.92 |
| $C_9$'s | 16.56 | 16.42 |
| Unidentified Heavies | 17.7 | 19.8 |

EXAMPLE 2

| | Conventional | DUO-CRACKING |
|---|---|---|
| Feedstock | Gas Oil | Gas Oil (line 18) Ethane (line 10) |
| Cracking Intensity | | |
| $CH_4$ wt % | 10.3 | 10.3 |
| Raw Pyrolysis Gasoline Products | | (line 40) |
| °API | 32.8 | 31.2 |
| Sp. Gr. 60/60 F | 0.861 | 0.870 |
| Bromine g/100 g | 47.9 | 40.7 |
| Iodine g/100 g | 24.5 | 23.7 |
| Boiling Range °F. | | |
| IBP | 114 | 137 |
| 50% | 215 | 214 |
| 95% | 367 | 360 |
| Analysis, C wt % | 90.99 | 91.08 |
| H | 9.01 | 8.92 |

-continued

| | Conventional | DUO-CRACKING |
|---|---|---|
| C/H | 10.10 | 10.21 |
| Hydrocarbon Types | | |
| Aromatics Vol % | 75 | 79 |
| Olefins | 24 | 20 |
| Saturates | 1 | 1 |
| RPG YIELDS | | |
| $C_5$-Mono Olefins | 1.02 | 0.64 |
| Isoprene | 2.46 | 1.32 |
| Other $C_5$ Di Olefins & Cyclopentene | 2.32 | 1.59 |
| Cyclopentadiene | 4.62 | 4.07 |
| Dicyclopentadiene | 1.97 | 1.21 |
| $C_5$'s | 12.39 | 8.83 |
| Methyl Cyclopentadiene | 0.67 | 0.62 |
| Benzene | 29.8 | 33.7 |
| Toluene | 19.2 | 20.7 |
| Ethylbenzenes | 2.07 | 2.03 |
| P-Xylene | 1.70 | 1.67 |
| M-Xylene | 3.68 | 3.55 |
| O-Xylene | 3.27 | 3.03 |
| Styrene | 3.06 | 2.92 |
| BTX | 63.45 | 68.22 |
| $C_9$'s | 14.59 | 13.41 |
| Unidentified Heavies | 9.57 | 9.54 |

The DUOCRACKING yield data reported in Examples 1 and 2 are only the gas oil contributions in the combined cracking process. The ethane contribution was obtained by allowing the ethane to crack under identical process conditions as the mixture. The ethane contribution was then subtracted from the mixture yields to obtain only the gas oil contribution under DUOCRACKING process conditions.

What is claimed:

1. A thermal cracking process for producing enhanced benzene, toluene and xylene yield from heavy hydrocarbon comprising the steps of:

(a) diluting the heavy hydrocarbon with about 0.2 pound of steam per pound of heavy hydrocarbon;

(b) partially thermally cracking the heavy hydrocarbon under medium severity conditions to temperatures of about 1200° F. to 1450° F. at a residence time of about 0.05 seconds;

(c) thermally cracking a stream of ethane to high conversion; and (d) mixing the partially thermally cracked hydrocarbon stream with the high temperature ethane stream that has been thermally cracked to high conversion to complete thermal cracking of the composite stream.

2. A thermal cracking process as in claim 1 wherein the ratio of heavy hydrocarbon to ethane is 65 to 35 by weight.

3. A thermal cracking process as in claim 1 wherein prior to partially cracking the heavy hydrocarbon stream, the heavy hydrocarbon stream is elevated to a temperature between 900° F. and 1000° F.

4. A thermal cracking process as in claim 1 wherein the ethane is cracked under high conversion conditions to temperatures between 1500° F. to 1700° F. at a residence time of about 0.1 to 0.3 seconds.

5. A thermal cracking process as in claim 4 wherein prior to cracking the ethane to high conversion, dilution steam superheated to a temperature of from 365° F. to 1000° F. is mixed with the ethane at approximately 0.4 pounds of steam per pound of ethane.

6. A thermal cracking process as in claim 5 wherein prior to cracking the ethane to high conversion, the diluted ethane is elevated in temperature to approximately 1000° F. to 1200° F.

* * * * *